United States Patent [19]

Ehrlich et al.

[11] 4,385,933

[45] May 31, 1983

[54] HIGHLY HEAT RESISTANT AUSTENITIC IRON-NICKEL-CHROMIUM ALLOYS WHICH ARE RESISTANT TO NEUTRON INDUCED SWELLING AND CORROSION BY LIQUID SODIUM

[75] Inventors: Karl Ehrlich, Karlsruhe; Waman Vaidya, Geesthacht; Ludwig Schäfer, Bruchsal, all of Fed. Rep. of Germany

[73] Assignee: Kernforschungszentrum Karlsruhe GmbH, Karlsruhe, Fed. Rep. of Germany

[21] Appl. No.: 269,784

[22] Filed: Jun. 2, 1981

[30] Foreign Application Priority Data

Jun. 2, 1980 [DE] Fed. Rep. of Germany ..... 3020844

[51] Int. Cl.[3] ..... C22C 38/06; C22C 38/22; C22C 38/28; C22C 38/32

[52] U.S. Cl. ..... 75/124; 75/128 A; 75/128 F; 75/128 N; 75/128 T; 75/128 W

[58] Field of Search ..... 75/124 C, 128 A, 128 F, 75/128 N, 128 T, 128 W

[56] References Cited

U.S. PATENT DOCUMENTS

| | | | |
|---|---|---|---|
| 2,519,406 | 8/1950 | Scott et al. | 75/128 T |
| 2,641,540 | 6/1953 | Mohling et al. | 75/128 T |
| 3,301,668 | 1/1967 | Cope | 75/128 F |
| 3,440,037 | 4/1969 | Martin et al. | 75/128 F |
| 4,011,133 | 3/1977 | Bloom et al. | 75/128 T |

*Primary Examiner*—W. Stallard

*Attorney, Agent, or Firm*—Spencer & Kaye

[57] ABSTRACT

A highly heat resistant, austenitic, iron-nickel-chromium alloy which is resistant to neutron induced swelling and to corrosion by liquid sodium, containing 8.0% to 15.0% by weight, chromium and 14.5% to 25.5%, by weight, nickel. When nickel is present in an amount of 14.0% to 21.0% by weight, the percent by weight of chromium present is less than or equal to $0.66\times$(the percentage of nickel)$+1.6\%$.

8 Claims, No Drawings

HIGHLY HEAT RESISTANT AUSTENITIC IRON-NICKEL-CHROMIUM ALLOYS WHICH ARE RESISTANT TO NEUTRON INDUCED SWELLING AND CORROSION BY LIQUID SODIUM

BACKGROUND OF THE INVENTION

The present invention relates to highly heat resistant austenitic iron-nickel-chromium alloys which are resistant to neutron induced swelling as well as to corrosion by liquid sodium. Such alloys also contain small amounts of manganese, molybdenum, titanium, silicon, carbon, nitrogen, and boron.

The problem of neutron induced swelling has been known for more than a decade in nuclear structural materials used in fast nuclear reactors, particularly fast breeder reactors, and in the cladding and wrapper materials of the fuel elements used in these reactors. Initially, attempts were made to master this problem with the aid of structural measures. Later, stainless chromium-nickel-steel alloys of certain compositions were proposed which, under certain circumstances, were to be additionally subjected to subsequent thermal and/or mechanical treatments in order to reduce swelling of the material of the formation of cavities in the material.

The materials listed in German Industrial Standards DIN Nos. 1.4970 and 1.4981 have been used as cladding or wrapper materials, in connection with the German/-Belgian/Netherlands fast breeder project. In other fast breeder projects the alloy employed was gradually the highly heat resistant austenitic steel known by the American Standard Term AISI 316. The British fast breeder project has selected the high nickel content austenitic material known by the trademark PE 16. The chemical compositions of these alloys are compiled in Table 1, below.

TABLE 1

Compositions of prior art Fe—Cr—Ni steels or alloys. (percent by weight)

| Element | DIN 1.4970 | DIN 1.4981 | AISI 316 | High Nickel Content (PE 16) |
|---|---|---|---|---|
| Cr | 14.8 | 17.0 | 17.7 | 17.2 |
| Ni | 15.1 | 16.6 | 13.4 | 43.7 |
| Mn | 1.75 | 0.97 | 1.80 | 0.02 |
| Mo | 1.20 | 1.64 | 2.26 | 3.08 |
| Ti | 0.40 | | | 0.92 |
| Si | 0.40 | 0.58 | 0.36 | 0.10 |
| C | 0.10 | 0.06 | 0.057 | 0.07 |
| N | 0.02 | 0.02 | 0.001 | 0.011 |
| B | 0.005 | 0.0004 | 0.0005 | 0.001 |
| Al | | | | 0.94 |
| Zr | | | | 0.015 |
| Nb | | 0.70 | | |
| Cu | | | 0.18 | |
| Fe | Remainder | Remainder | Remainder | Remainder |

Attempts have also been made to optimize these steels with respect to swelling by suitable thermal or mechanical pretreatments, such as 20% cold working. The low nickel content commercial austenites, such as, AISI 316 and DIN 1.4970 exhibit a relatively high degree of swelling when in the solution heat treated state: approximately 6 to 10% at 40 dpa or $8\times10^{22}$ neutrons per $cm^2$ at 500° C.±25° C. With the use of cold working, this swelling can be reduced. In general the displacement damage during irradiation is given in displacements per (lattice) atom with the abbreviation dpa.

The physical model underlying these calculations is the Norgett-Robinson-Torrens model. However, under the influence of radiation at higher process temperatures, those of at least 550° C., there occurs accelerated recovery and/or recrystallisation of the cold working.

It is also possible to reduce swelling by utilizing high nickel content austenites such as PE 16, containing approximately 40% nickel. At comparable neutron doses and temperatures, swelling lies at about 1%. With this alloy, it is necessary to revert to hardening by means of the $\gamma'$-phase precipitation mechanism, in order to attain sufficient strength. In this case, the precipitation of the $\gamma'$ phase consisting of $Ni_3Al$ or $Ni_3(AlTi)$ can be realized only by heat treatment at 700° to 800° C. The high nickel content austenites and nickel alloys are disadvantageous in their reduction of the breeding rate and an increase in wear by corrosion in liquid sodium.

SUMMARY OF THE INVENTION

It is an object of the present invention to provide alloys for structural elements in fast breeder reactors and fusion reactors, and for nuclear fuel and breeder element claddings and wrappers.

It is another object of the present invention to provide alloys which, even after long periods in a reactor, are not or are only minimally subject to neutron induced swelling and are not subject to recrystallization processes at higher temperatures.

It is a further object of the present invention to provide alloys which do not have the disadvantages of the high nickel content austenites or nickel base alloys, such as reduction in breeding rate and increased wear due to corrosion by liquid sodium.

To achieve these objects, and in accordance with its purpose, the present invention provides a highly heat resistant, austenitic iron-nickel-chromium alloy which is resistant to neutron induced swelling and to corrosion by liquid sodium, which contains, by weight, 8% to 15.5% chromium, 14.5% to 25.5% nickel, 1.5% to 2.0% manganese, 1.3% to 1.7% molybdenum, 0.25% to 0.5% titanium, 0.29% to 1.0% silicon, 0.09% to 0.12% carbon, 0.005% to 0.01% nitrogen, 0.003% to 0.01% boron, and the remainder iron, and manufacturing impurities. In the alloys of the present invention, when nickel is present in an amount of 14.5% to 21.0% by weight, the percentage, by weight, of chromium is less than or equal to 0.66×(the percentage of nickel)+1.6%.

It is to be understood that both the foregoing general description and the following detailed description are exemplary, but are not restrictive of the invention.

DETAILED DESCRIPTION OF THE INVENTION

The alloys of the present invention are iron-base austenitic alloys containing chromium and nickel. These alloys are in general subject to less than 3% neutron induced swelling, and are not subjected to recrystallization at temperatures equal to or greater than 550° C.

The composition of the presently claimed alloys can be seen from the drawing figure. The alloys will contain about 8.0% to 15.5% by weight chromium and about 14.5% to 25.5% by weight nickel. However, when the nickel content is 14.5% to 21.0%, the chromium content is less than or equal to 0.66×(the percentage of nickel)+1.6%.

Compositions in which the Ni content is 14.5% to 21.0%, and the Cr content is greater than 0.66×(the percentage of Ni)+1.6% are excluded from the present invention. Alloys having these excluded compositions may have neutron induced swelling greater than 3%. For example, the Fe-Cr-Ni steel DIN 1.4970, containing 15.1% Ni and 14.8% Cr, is within the excluded area, and has been observed with a swelling of 4%. Swelling of about 6% was noted for an alloy including Fe-15%Cr-15%Ni-0.025%C.

The alloys of the present invention also contain, by weight, 1.5% to 2.0% manganese, 1.3% to 1.7% molybdenum, 0.25% to 0.5% titanium, 0.29% to 1.0% silicon, 0.09% to 0.12% carbon, 0.005% to 0.01% nitrogen, 0.003% to 0.01% boron, and the remainder iron, and manufacturing impurities such as phosphorus and sulfur.

In an advantageous embodiment of the invention, the content of the aluminum, which is part of the impurities inherent in the manufacturing process, is less than or equal to 0.1 percent by weight, and reacts as deoxidizer.

Particularly suitable for use as cladding and wrapper materials for fuel elements are non-$\gamma'$ hardened alloys of the two groups listed below. Group I is characterized by alloy component contents within the ranges, by weight, 9.0% to 15.4% Cr, 14.7% to 25.05% Ni, 1.79% to 1.87% Mn, 1.32% to 1.45% Mo, 0.46% to 0.50% Ti, 0.07% to 0.10% Al, 0.29% to 0.37% Si, 0.11% to 0.12% C, <0.005% to 0.007% N, and 0.005% to 0.008% B.

Impurities inherent in the manufacturing process in the form of P are present at less than 0.005% and in the form of S are present at less than 0.006% by weight. The remainder of the alloy is iron.

Group II alloys are characterized by alloy component contents within the ranges, by weight: 8.0% to 12.0% Cr, 19.5% to 25.05% Ni, 1.5% to 2.0% Mn, 1.3% to 1.7% Mo, 0.25% to 0.5% Ti, near 0.1% but not higher Al, 0.3% to 1.0% Si, 0.09% to 0.12% C, less than 0.01% N, and 0.003% to 0.01% B.

Impurities inherent in the manufacturing process in the form of P are present at less than 0.005% and in the form of S are present at less than 0.006% by weight. The remainder of the alloy is iron.

By using the certain compositions of the alloy components in these two groups, better stability in the $\gamma$ range is realized compared to the prior art Fe-Cr-Ni steel of DIN 1.4970, without any noticeable change in the corrosion in liquid sodium or in the breeding rate. The mechanical properties of the alloys in these two groups are about the same as the steel of DIN 1.4970 and are better than the steel according to DIN No. 1.4981.

No precipitations take place under the influence of radiation in the alloys of the present invention. The segregation phenomena which occur very frequently at pores in the prior art alloys of Table 1 are not observed in the alloys of Group I and II according to the invention. These alloys eliminate the need for increasing strength by $\gamma'$ precipitation. In this way, it is possible to avoid the problem of instability of the $\gamma'$ phase under irradiation, the problem of precipitation of swelling reducing elements, such as Cr, Ni, Al, Ti, Si, and the problems occurring during melting of the alloys and producing cladding and wrappers if $\gamma'$ hardening is used. These problems include the necessity for additional heat treatments.

In cases where alloys with higher strength are preferred, there is a further embodiment of the invention based on a modification of the amounts of three alloy components of the alloys of Group II. These Group III alloys are characterized by the simultaneous increase in the amounts of titanium and aluminum and the corresponding change in the amount of carbon. Group III alloys thus comprise 2.5% to 3.0% by weight Ti; 0.5% to 1.5% by weight Al, and 0.05% to 0.1% by weight C.

The alloys of Groups I and II receive a significant portion of their heat resistance from the precipitation of TiC particles. An alternative embodiment of the present invention provides Group IV alloys which are characterized by an additional amount of vanadium, increased amounts of molybdenum and nitrogen, a corresponding change in the amount of Ti, a reduction in the amount of C, and elimination of the Al content. These alloys are of the composition, by weight, 9.0% to 11.0% Cr, 19.5% to 25.05% Ni, 1.4% to 1.6% Mn, 2.2% to 2.6% Mo, 0.2% to 0.4% Ti, 0.4% to 0.6% V, 0.4% to 0.6% Si, 0.01% to 0.03% C, 0.08% to 0.12% N, and 0.004% to 0.006% B.

Impurities inherent in the manufacturing process in the form of P and S are present at a combined total of less than 0.005 percent by weight. The remainder of the alloy is iron.

These Group IV alloys receive their heat resistance by precipitation of a phase of vanadium nitride. As a result of the reduced tendency of the VN particles to coagulate, a greater creep resistance is noted.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLES 1 TO 3

The alloys of Table 2 were prepared according to the present invention:

TABLE 2

| | Components (% by weight) | | |
|---|---|---|---|
| Element | Example 1 | Example 2 | Example 3 |
| Cr | 9.0 | 10.2 | 15.4 |
| Ni | 14.7 | 25.0 | 25.05 |
| Mn | 1.79 | 1.87 | 1.83 |
| Mo | 1.32 | 1.42 | 1.45 |
| Ti | 0.50 | 0.46 | 0.48 |
| Al | 0.068 | 0.10 | 0.10 |
| Si | 0.29 | 0.35 | 0.37 |
| C | 0.12 | 0.11 | 0.11 |
| N | 0.007 | 0.007 | 0.005 |
| B | 0.0050 | 0.0080 | 0.0075 |
| P | <0.005 | <0.005 | <0.005 |
| S | 0.005 | <0.006 | <0.006 |

The sample material of the three test alloys was produced according to the following procedure:

The alloying elements were melted in a vacuum induction furnace in a crucible lined with MgO and having a capacity of 25 kg. The starting materials serving as basis for the alloys were electrolytic iron of about 99.9% purity, Mond process nickel, free of cobalt and greater than 99.99% purity, and electrolytic chromium of at least about 99.9% purity. Care was taken that the annoying impurities, such as S, P, and N, were minimized in the starting materials. Iron, nickel, chromium and molybdenum were melted first and the melt was then degassed. During this time the temperature was kept at about 1600° C. Shortly before tapping, Ti and Mn were added as pure metals, Si and B were added in the form of ferro alloys, the melt was held at about 1540° C. and then cast under vacuum into copper molds. The blocks had dimensions of about 100 mm diameter×350 mm.

In order to obtain a better structure, the blocks were remelted. The remelted blocks were then forged into rods of approximately 75 mm diameter and were shaved by turning. Then the rods were heated in a vacuum electric arc furnace with self-consuming electrodes and dripped into new molds. With this remelting, the possibility of the elements segregating, which could result in poorer mechanical and chemical properties of the alloy, could be avoided. Moreover, uniform distribution of the elements was also assured. The blocks had dimensions of about 110 mm diameter×260 mm.

For the production of rods, the blocks were preheated, preforged at about 1150° to 1160° C. and then forged at 950° to 1000° C. to their final dimensions of about 60 mm diameter×700 mm.

In order to realize better homogenization of the elements in the alloys, the forged rods were heat treated at 1080° to 1100° C. for 1 to 6 hours under a vacuum or a protective atmosphere of argon, and quenched in water. Since the alloys are entirely in the single-phase $\gamma$ austenite range, they can be cold or hot worked without difficulty.

For the production of sheet metal, discs were cut from the rods and cold worked, in stages, to 50% each time, until a thickness of about 0.16 mm had been reached. Intermediate heat treatment as well as subsequent quenching took place at 1000° C. for 1 hour in a vacuum. Depending on the degree of cold working, grain sizes between 30 to 60$\mu$ could be achieved. Final solution annealing was performed at 1150° C. for 30 min in vacuum.

Instead of neutron bombardment, the three alloys were subjected to a bombardment with $Ni^{6+}$ ions at 575° C., which had a similar effect (70 displacements per atom). As a comparison, samples of the alloy according to DIN 1.4970 and the quaternary alloy Fe-15Cr-15Ni-0.025C were treated similarly. After irradiation, the alloys had the values for the radiation induced swelling according to Table 3:

TABLE 3

| Alloy | % Swelling |
|---|---|
| Example 1 | 2.5% |
| Example 2 | less than 1% |
| Example 3 | 2.5% |
| Alloy according to DIN 1.4970 | 4% |
| Fe-15%Cr-15%Ni-0.025%C | 6% |

The alloys according to the invention can also be worked well industrially, making it possible to produce nuclear fuel element claddings from all alloy groups.

The production procedure of Group III and Group IV alloys was identical to that of Group I and Group II alloys described above.

It will be understood that the above description of the present invention is susceptible to various modifications, changes and adaptations, and the same are intended to be comprehended within the meaning and range of equivalents of the appended claims.

What is claimed is:

1. A highly heat resistant, austenitic iron-nickel-chromium alloy which is resistant to neutron induced swelling and to corrosion by liquid sodium, comprising, by weight:

(a) 8.0% to 15.5% chromium;
(b) 14.5% to 25.5% nickel;
(c) 1.5% to 2.0% manganese;
(d) 1.3% to 1.7% molybdenum;
(e) 0.25% to 0.5% titanium;
(f) 0.29% to 1.0% silicon;
(g) 0.09% to 0.12% carbon;
(h) 0.005% to 0.01% nitrogen;
(i) 0.003% to 0.01% boron; and
(j) the remainder, iron and manufacturing impurities, wherein when nickel is present in an amount of 14.5% to 21.0%, by weight, the percentage, by weight, of chromium present is less than or equal to 0.66×(the percentage of nickel)+1.6%.

2. Alloy as defined in claim 1, additionally comprising no more than 0.1% by weight aluminum, as a manufacturing impurity, reacting as deoxidizer.

3. Alloy as defined in claim 1 or 2, wherein Cr is present at 9.0 to 15.4% by weight, Ni is present at 14.7 to 25.05% by weight, Mn is present at 1.79 to 1.87% by weight, Mo is present at 1.32 to 1.45% by weight, Ti is present at 0.46 to 0.50% by weight, Si is present at 0.29 to 0.37% by weight, C is present at 0.11 to 0.12% by weight, N is present at less than 0.005, to 0.007% by weight, and B is present at 0.005 to 0.008% by weight, wherein said manufacturing impurities comprise 0.07 to 0.10% by weight Al, less than 0.005% by weight in the form of P, and less than 0.006% in the form of S, and the remainder of the alloy comprises iron.

4. Alloy as defined in claim 1 or 2, wherein Cr is present at 8.0 to 12.0% by weight, Ni is present at 19.5 to 25.05% by weight, Mn is present at 1.5 to 2.0% by weight, Mo is present at 1.3 to 1.7% by weight, Ti is present at 0.25 to 0.5% by weight, Si is present at 0.3 to 1.0% by weight, C is present at 0.09 to 0.12% by weight, N is present at less than 0.01% by weight, and B is present at 0.003 to 0.01% by weight, wherein said manufacturing impurities comprise about, but not more than 0.1% by weight Al, less than 0.005% by weight in the form of P, and less than 0.006% by weight in the form of S, and the remainder of the alloy comprises iron.

5. A highly heat resistant, austenitic iron-nickel-chromium alloy which is resistant to neutron induced swelling and to corrosion by liquid sodium, comprising, by weight, (a) 8.0 to 12.0% Cr,
(b) 19.5 to 25.05% Ni,
(c) 1.5 to 2.0% Mn,
(d) 1.3 to 1.7% Mo,
(e) 2.5 to 3.0% Ti,
(f) 0.5 to 1.5% Al,
(g) 0.3 to 1.0% Si,
(h) 0.05 to 0.1% C,
(i) less than 0.01% N,
(j) 0.003 to 0.01% B,
(k) manufacturing impurities comprising less than 0.005% in the form of P and less than 0.006% in the form of S, and
(l) the remainder, Fe.

6. A highly heat resistant, austenitic iron-nickel chromium alloy which is resistant to neutron induced swelling and to corrosion by liquid sodium, comprising, by weight:

(a) 9.0 to 11.0% Cr,
(b) 19.5 to 25.05% Ni,
(c) 1.4 to 1.6% Mn,
(d) 2.2 to 2.6% Mo,
(e) 0.2 to 0.4% Ti,
(f) 0.4 to 0.6% V, (g) 0.4 to 0.6% Si,
(h) 0.01 to 0.03% C,
(i) 0.08 to 0.12% N,
(j) 0.004 to 0.006% B,
(k) manufacturing impurities comprising a combined total in the form of P and S of less than 0.005%, and
(l) the remainder Fe.

7. Alloy as defined in claim 1, 2, 5, or 6, which is subject to less than 3% neutron induced swelling.

8. Alloy as defined in claim 1, 2, 5, or 6, which is not subject to recrystallization at temperatures equal to or greater than 550° C.

* * * * *